United States Patent [19]

Muhlhoff

[11] Patent Number: 4,854,900

[45] Date of Patent: Aug. 8, 1989

[54] PRESS FIT PIN

[75] Inventor: Carl H. Muhlhoff, Heilbronn, Fed. Rep. of Germany

[73] Assignee: Amphenol Corporation, Wallingford, Conn.

[21] Appl. No.: 814,531

[22] Filed: Dec. 20, 1985

Related U.S. Application Data

[63] Continuation of Ser. No. 713,564, Mar. 18, 1985, abandoned, which is a continuation of Ser. No. 459,155, Jan. 19, 1983, abandoned.

[30] Foreign Application Priority Data

Jan. 19, 1982 [DE] Fed. Rep. of Germany ..... 3201464
Jun. 9, 1982 [DE] Fed. Rep. of Germany ..... 3221844

[51] Int. Cl.[4] ..... H01R 13/428
[52] U.S. Cl. ..... 439/751; 439/82
[58] Field of Search ..... 339/17 C, 220 R, 221 R, 339/221 M; 439/82, 751, 825–827, 873

[56] References Cited

U.S. PATENT DOCUMENTS

| | | | |
|---|---|---|---|
| 3,223,960 | 12/1965 | Ruehlemann | 339/221 R |
| 3,824,554 | 7/1974 | Shaholm | 339/221 R |
| 3,827,004 | 7/1974 | Vanden Heuvel et al. | 339/221 R |
| 3,862,792 | 1/1975 | Jayne | 339/221 R |
| 4,464,009 | 8/1984 | Thaler | 339/221 R |

*Primary Examiner*—Gary F. Paumen
*Attorney, Agent, or Firm*—Bacon & Thomas

[57] ABSTRACT

Press in pin with a press in section insertable with force fit into a through connection hole in a printed circuit board, which section has two narrow sides extending in lengthwise direction of the pin and two wide sides indentations being provided in the wide sides which define a central section, at which lateral sections are arranged opposite each other with respect to the transverse axis of the cross-section to give the press in zone a certain flexibility, the two lateral sections being symmetrical both to the transverse axis and to the longitudinal axis normal to axis of the cross-section.

8 Claims, 5 Drawing Sheets

PRESS FIT PIN

This application is a continuation of application Ser. No. 713,564 filed Mar. 18, 1985, now abandoned, which is a continuation of application Ser. No. 459,155 filed Jan. 19, 1983, now abandoned.

BACKGROUND OF THE INVENTION

The invention concerns a press fit contact, particularly a so-called press fit or termination pin, which can be inserted into a through connection hole of a printed circuit board or the like, and thus the manufacture of a solderless electrical and mechanical connection between the printed circuit and the insert pin. The insert pin has two contact ends positioned diametrically, with the one contact end in the form of a wrapping post, for example, while the other contact end is a plug pin or even a jack, for example. Preferably the invention concerns an insert pin with its press fit section rectangular in shape and with indentations provided in the area of the press fit section.

Press fit pins, especially for printed circuit boards, with a press fit area are already well known. It would be desirable to provide an insert pin in such a way that the through connection holes can be equipped with press fit pins without any drawbacks arising even when notable hole tolerances are present. It would also be desirable to provide a press fit pin which is easy to manufacture.

SUMMARY OF THE INVENTION

In accordance with this invention, there is provided a press fit pin having a press fit section insertable into a through connection hole in a printed circuit board or the like, the press fit section being of rectangular cross-section and having indentations in its wide sides extending along the length of the press fit section, characterized in that in one of the wide sides a single large central indentation is provided and in the other wide side two small indentations are provided such that the press fit section has an "M" shaped crosssection.

The press fit pin of the invention avoids having the contact ends connected to the pin rotate against the press fit area. Also, all four edges of the press fit area penetrate in an essentially uniform manner into the contact area of the through connection hole. This avoids a weaker penetration of two diametrically positioned edges compared to the other edges which could damage the pin.

Also in accordance with this invention, there is provided a press fit pin having a press fit section insertable with a press fit into a through connection hole in a printed circuit board or the like, the press fit section comprising two narrow sides in the longitudinal direction of the pin and two wide sides in which indentations are provided which define a central section at which lateral sections are arranged opposite each other with respect to a transverse axis of the crosssection of the pin to provide the press fit section with flexibility, characterized in that the lateral sections are symmetrical both to the transverse axis and the longitudinal axis of the cross-section of the pin.

In the case of an M-shaped press in zone, a warping of the press in pin may occur during its production. Besides, it is difficult to make the outer contour of the M-shaped cross-section rectangular and not trapezoidal because although the press in zone can indeed be machined from above and below on a conveyor belt, it is difficult to do so from the side. However, for positioning the press in pin in the center of the hole on the printed circuit board a rectangular contour of the press in zone is required.

Since the second embodiment of the invention provides on both sides of the rectangular cross-section the same notches, a completely symmetrical form results, which is not the case with the M-shaped press in zone and may there lead to the mentioned bending or warping of the press in pin.

The pin according to the invention is of especially sturdy construction, as its core zone or its central section is not deformed. A very special advantage of the pin of the invention is that it may be machined only from the top and bottom, hence not from four sides.

By means of the measures set forth in the invention, a press fit pin is produced which can be inserted in a simple, flexible and pliable manner in a through hole and will hold fast safely and without tilting providing an exceptional contact without, moreover, destroying the contact material.

DESCRIPTION OF THE PREFERRED EMBODIMENTS

Figures 1, 2, 3:
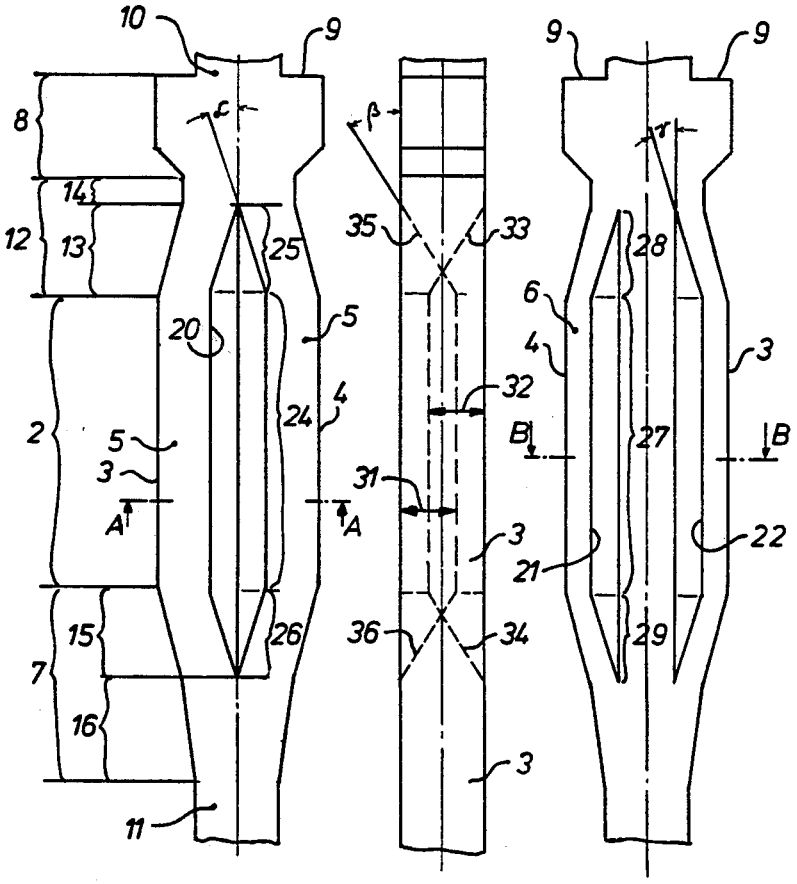
FIG. 1 is a partial view of the upper wide side of a press fit pin of the invention.
FIG. 2 is a view of the press fit pin of FIG. 1 from the left in FIG. 1 (view of the narrow side)
FIG. 3 is a view of the lower part of the press fit pin of FIG. 1 (view of lower wide side)

The press fit or termination pin constructed as set forth in the invention preferably is intended for insertion into a printed circuit board 51 (FIGS. 6*a* and 6*b*) by means of a press fit. For this purpose, the circuit board 51 normally has in any case at least several through connection holes 50 generally with several press fit pins that can be inserted into the holes 50 simultaneously by means of a press fit. Each of the press fit pins is provided with one press fit section so that in this way a solderless electrical and mechanical connection with the circuit board can be produced. Usually several press fit pins are provided that are connected together as on a comb by means of a carrier strip.

Referring to the embodiment of FIGS. 1-6, the press fit pin 1 preferably has rectangular press fit section 2, which has two narrow sides 3,4 as well as two wide sides 5,6. One single larger indentation 20 is provided in the center of the wide side 5 (top of FIG. 1). Two smaller indentations 21,22 are provided in the other wide side 6 (FIG. 3) in such a way that a press fit area 2 with an essentially M-shaped cross-section (FIG. 5) is produced.

An intermediate section 12 is connected upwards to the press fit section 2 (FIGS. 1 to 3), followed by an insertion shoulder section 8 and finally a first contact end 10. The first contact end 10 can be constructed as a wrapping post, for example, that can have any crosssection desired, such as rectangular.

An insertion section 7 is connected to the lower part of the press fit section 2 which in turn has a second contact end 11, which, for example, can be used as a plug pin. The second contact end 11 can have any cross-section, also a rectangular one, for example. The insertion section 7 is comprised of a first part 15 and a second part 16 with the parts 15,16 providing a continuous transition from the cross-section of the second contact end 11 to the cross-section of the press fit section 2. The thickness 65 (FIG. 5) of the press fit area is equal to the thickness of the remaining press fit pin 1, as can be seen clearly in FIG. 2.

The press fit pin 1 extends from the second contact end 11 to the press fit area 2 (the view of the upper wide side 5 in FIG. 1), and the intermediate section 12 has a slanted or tapering section 13 in the top view in FIG. 1, to which a rectangular section 14 running in a straight line in the top view is connected, which has retained the original cross-section of the material for the press fit section 2. The insertion shoulder section 8 which forms the insertion shoulders 9 is connected to the intermediate section 12 and the insertion shoulder section 8 in turn as a width corresponding more or less to that of the press fit section 2 which is obtained from the rectangular section 14 running along an extended slant or taper.

Figure 5:
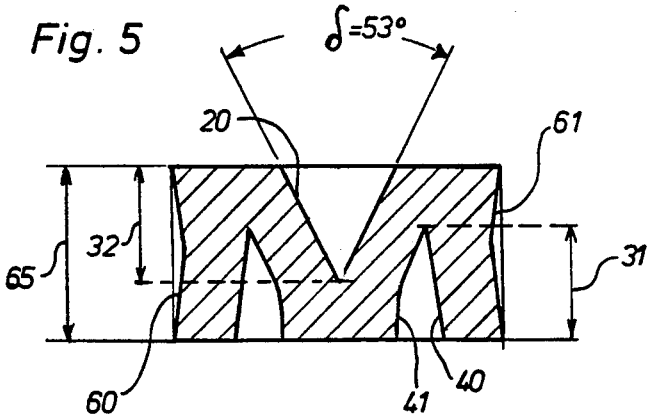
FIG. 5 is a sectional view along line A—A in FIG. 1 after completion of both manufacturing process stages as set forth in the invention.

The larger indentation 20 provided on the wide side 5 essentially runs along the entire press fit section 2 and in the area of the press fit section 2 it has preferably a uniform cross-section in the shape of an isosceles triangle as is shown in FIG. 5. Preferably the two side walls of the larger indentation 20 (FIG. 5) form an angle in the range between 40° and 60°. For example, the angle is 53°. However, depending on the need, angles of any other size may be selected as well. The depth 32 of the larger indentation 20 (FIG. 2 and FIG. 5) is preferably greater than half the thickness 65 of the press fit area.

As can be seen in FIGS. 1 and 2, the depth 32 and also the width of the larger indentation 20 decreases upwards in the area of the inclined section 13 and downwards in the area of the first part 15 of the insertion section 7 all the way to zero. These indentation portions tapering in the shape of a triangle towards the closest end of the press fit pin are labeled as the first indentation part 25 and as the second indentation part 26. The decrease in the depth of the larger indentation 20 at 33 and 34 on the top and bottom ends can also be seen in FIG. 2.

The two smaller indentations 21,22 are positioned symmetrically with the center line (FIG. 3) and are constructed as a mirror image to it. For this reason the smaller indentation 21 on the left in FIG. 3 will be explained in greater detail. Like the larger indentation 20, the smaller indentation 21 has a smaller indentation section 27 having essentially a constant width. A first indentation section 28 having a width that tapers essentially like a triangle connects at the top to the indentation section 27 and a second indentation section 29 also tapering essentially like a triangle is connected at the bottom. The width of the indentation sections 28 and 29 decreases more or less like a right triangle so that wall zones of an essentially uniform width are produced. The depth of the first and second indentation sections 28,29 also decrease gradually as is shown at 35 and 36 in FIG. 2 for the smaller indentation 22.

The triangles formed by the indentation portions or parts 25,26 form the angle shown in FIG. 1, which preferably is in the range of 10° to 40°, and is 18° in the illustrated embodiment. Also the indentation sections 28 and 29 of the smaller indentation 21 as well as the indentation section of the smaller indentation 22 which are not shown in detail form the opposite angle shown in FIG. 3, which is preferably between 10° and 40° and is 18° in the illustrated embodiment. It should also be pointed out that the decrease in the depth 35 occurs at an angle 8 of preferably 20° to 40°, and in the illustrated embodiment it occurs at 33°. Although the angle sizes are preferred, angles of other sizes can also be used, of course, depending on the particular needs in each case.

The two smaller indentations 21,22 preferably have the cross-section shown in FIG. 5 in the area of the indentation portion 27 having a constant width. As shown in FIG. 5, the smaller indentations 21,22 each have a flat external wall 40 as well as an internal wall 41 angled as shown.

In the area of the press fit section 2, the narrow sides 3 and 4 also have recesses 60,61 that are like a flat saucer in shape.

Figure 4:
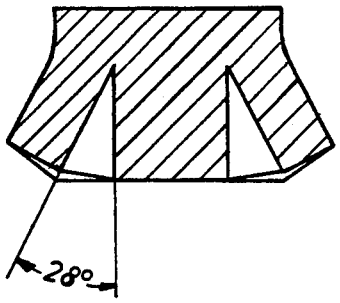
FIG. 4 is a sectional view along line B—B in FIG. 3. after the first manufacturing process stage.

The press fit section 2 is manufactured as follows. The material having originally a rectangular shape in the press fit section 2 is provided with two lateral notches preferably by cutting (FIG. 4). In a second manufacturing process, the larger indentation 20 is constructed from the opposite side in the manner shown in FIG. 5, preferably by cutting, by which means the two notches arranged on one side as shown in FIG. 4 assume the shape shown in FIG. 5. If need be, the outer contour of the press fit section 2 can still be cut into shape thereafter.

The process as set forth in the invention is particularly suitable for manufacturing a flexible press fit section 2 when using press fit pins that are punched or those that are made of drawn wire. The press fit pin of the invention can be produced in a simple manner and, because of its design, it allows for a considerable hole tolerance in the through connection holes 50 in the printed circuit board. All four edges of the press fit section 2 produce an exceptional contact and provide an exceptionally tight fit. The press fit pin 1 of the invention is on the whole rigid, but it has on the other hand a press fit section 2 with desirable flexibility and pliability characteristics. The M shape of the press fit section 2 is pressed together more or less when it is inserted in a hole 50 depending on the bore diameter. In an extreme example, with the smallest possible bore, it can be pressed together so much that the original rectangular cross-section will be achieved again. The force required to press it together as well as the retention force of the press fit pin in the hole can be influenced by the depth of the indentations 20,21 and 22. The press fit pin 1 set forth in this invention has an extraordinarily high retention force, which is particularly advantageous when the hole diameters are large.

It should be pointed out that both the larger indentation 20 and the smaller indentations 21,22 can have tips rounded off at the bottom, which will result in the press fit pin 1 having a greater flexibility.

It should also be noted that the indentations 21,22 are tapered at their top and/or bottom ends; i.e., the tapered indentation portions 25, 26 and the tapered indentation sections 28,29. The tapering indentation portion 26 and the tapering indentation sections 29 make it possible to insert the press fit pin gently into the hole 50.

Figure 6A:
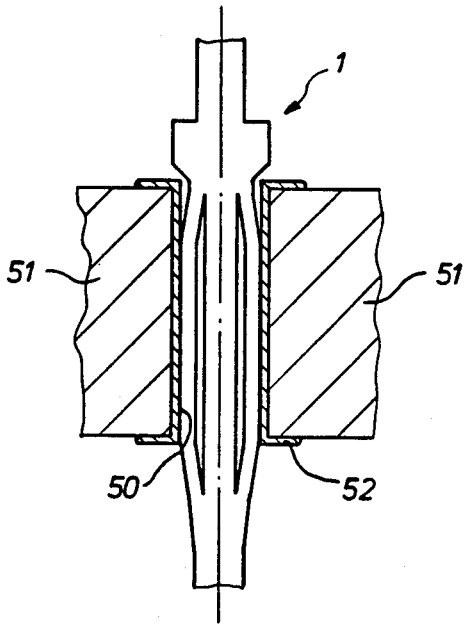
FIGS. 6*a* and 6*b* are schematic drawings of the arrangement of a press fit pin in circuit boards of different thicknesses.

FIG. 6*a* shows a press fit pin when it is inserted in a relatively thick printed circuit board 51, in a hole 50 that is coated with a contact layer 52.

Figure 6B:
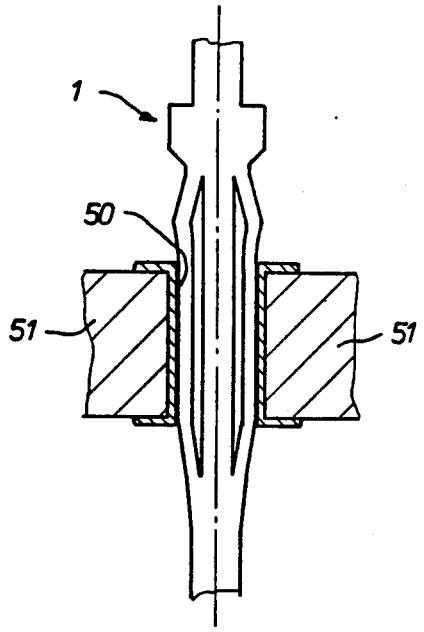

FIG. 6*b*shows a press fit pin inserted into a thinner circuit board.

As for the range of sizes for the press fit pin, it should be mentioned that it can be 1.0–1.2 mm wide, for example. The thickness can be 0.6 mm, for example.

In FIGS. 7 to 10 another embodiment of the invention is described, which has a completely symmetrical cross-section form of the press in zone. For this embodiment the same reference symbols as in the first embodiment have been used o the extent possible.

The press in pin 100 of the invention has a preferably rectangular press in section 102 with two narrow sides 3, 4 and two wide sides 5, 6. Indentations extending in lengthwise direction of the press in pin 100 in the form of two slots 155, 156 are formed in the wide side 5, and symmetrically thereto two slots 157, 158 (see FIG. 10) in wide side 6. The slots 155 to 158 are preferably symmetrical in pairs. That is, the slots 155 and 156 are arranged symmetrical or mirror symmetrical to the transverse axis of the cross-section and the same applies to the slots 157 and 158. Further the slots 155 and 157 are arranged symmetrical or mirror-symmetrical to the longitudinal axis, and this is true also of the slots 156 and 158.

Contiguous to the press in section 102 (FIG. 7) is upwardly a press in shoulder section 108 which is connected to a first contact end 10. Downwardly there is contiguous to the press in section 102 a lead-in section 107, which terminates in the second contact end 11. For the rest, reference is made to the description of the first embodiment.

Figure 7:
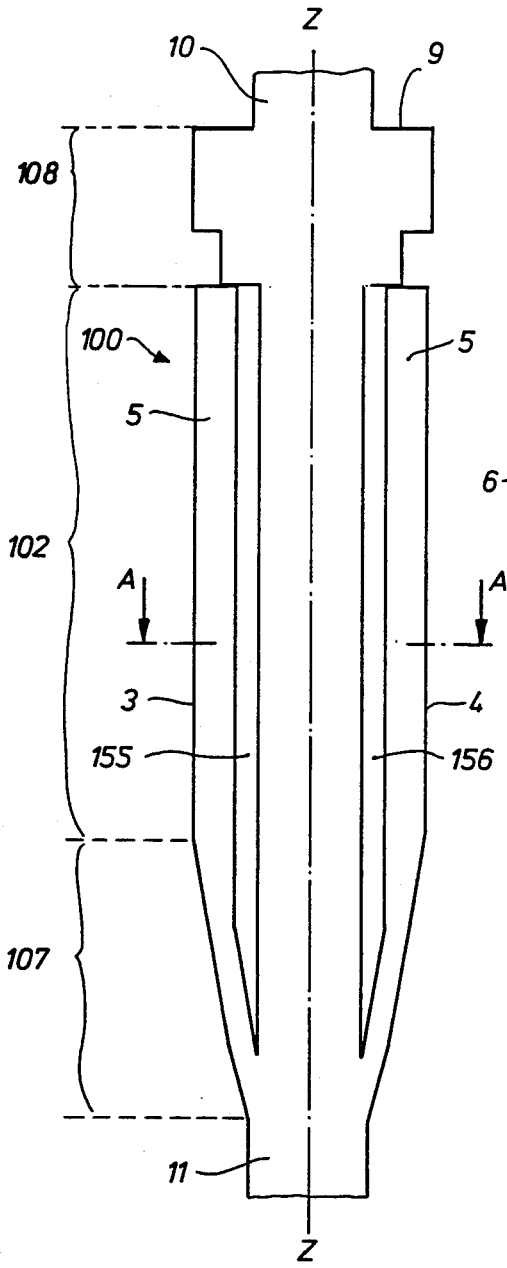
FIG. 7 is a partial view similar to FIG. 1 of another embodiment of the invention.
Figure 8:
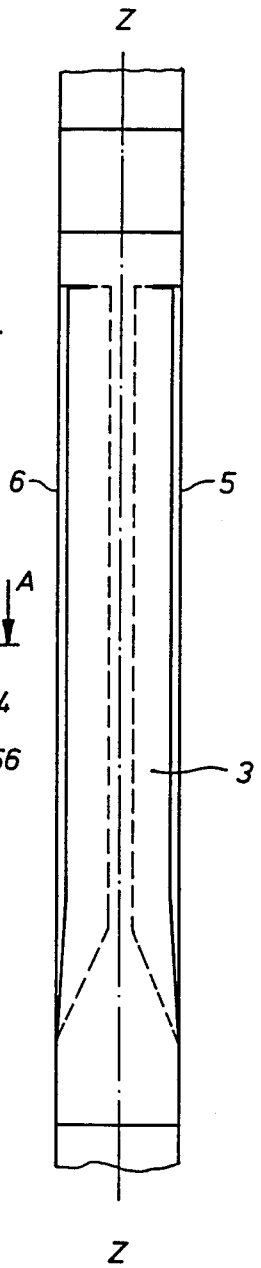
FIG. 8 is a view similar to FIG. 2 of the embodiment of FIG. 7

In the embodiment according to FIGS. 7 to 10, the press in section 102 terminates at its upper end in the press in shoulder section 108 without a transitional section. In the lead-in section 107 of the second embodiment, a tapering of pin 100 to the contact end 11 occurs already before also the slots 155, 156, 157, 158 begin to taper as shown in FIG. 7.

Figure 10:
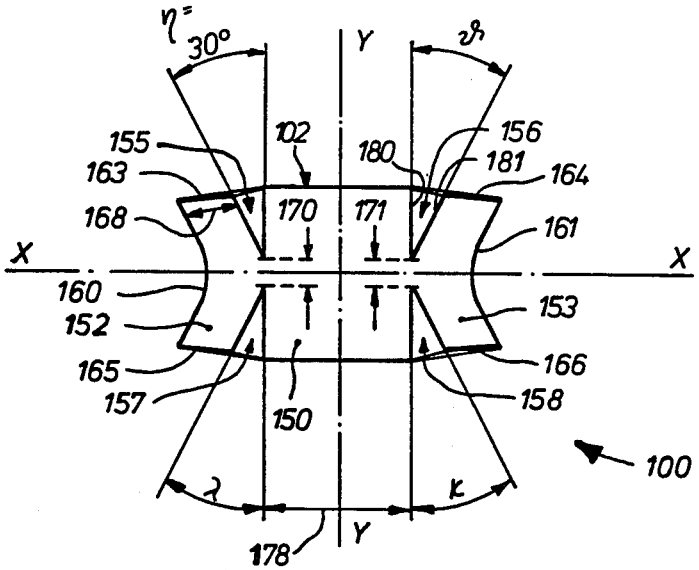
FIG. 10 is an enlarged representation of the sectional view of FIG. 9 but without the inclined edges shown in FIG. 9.

FIG. 10 shows the cross-section of the press in zone 102. The press in zone 102 comprises in crosssection a square central section 150, at which are provided on both sides symmetrical to the longitudinal axis X—X of the cross-section and also symmetrical to the transverse axis of the cross-section lateral sections in the form of legs 152, 153, in the embodiment shown in one piece with the central section 150. These legs 152, 153 are formed by indentations in the form of slots or notches 155,156, 157, 158, which are symmetrical to each other in pairs.

The slots 155 to 158 have in cross-section opening angles of equal size, for example in the order of 30°.

The holding force of press in pin 100 can be influenced by varying the leg thickness 168. Further the holding force or respectively elasticity can be influenced by variation of the connecting bridge thicknesses 170, 171. In the embodiment shown the sum of the two leg thicknesses 168 is approximately equal to the width of the central section 150.

One of the two sides 180,181 of the slots 155 to 158, namely side 180 on the side of the central section 150, extends substantially normal to the axis in lengthwise direction of pin 100.

Figure 9:
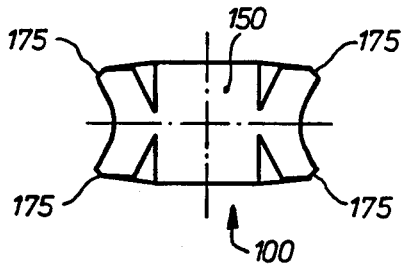
FIG. 9 is a section view along line A—A of FIG. 7.

The longitudinal sides 160,161 of the legs are preferably concave. The transverse sides 163 to 166 of the legs are offset somewhat toward the longitudinal axis and may have bevels 175 toward the concave side (FIG. 9).

In the embodiment shown, the central section 150 has essentially a square shape. However, it may be a different shape. The width 178 of the central section may be varied as required, as may also the leg thickness 168.

The contact pin in particular according to FIGS. 7–10 can contact equally well through-connection printed circuit board holes with diameters in a certain tolerance range. This tolerance range can be shifted upward or downward very easily by changing the diameters 178.

As the core or central section 150 of pin 100 is not deformed, a very good stability is ensured.

Conceivable is also an oblique extension of the notches 155–158 toward the first contact end 10. However, it has been found especially advantageous to limit the notches rectilinearly. That is, the notch depth also becomes abruptly zero (see FIG. 8). As a result, the material tears at the transition from section 102 to 108 and is not stretched, which would lead to unnecessary strains. Naturally such a configuration is not possible in the lead-in region 107.

The production of the press in zone or press in section 102 is effected according to the following steps:

1. Stamping of a rectangular cross-section.
2. Notching of the slots 155 to 158 by means of a double-edged notching punch from below and from above, preferably simultaneously.

If necessary or desired, after the first step a light chamfering in the form of bevel faces 175 can be effected at the four edges of the cross-section.

I claim:

1. A press fit pin with a press fit section insertable with a press fit into a through connection hole in a printed circuit board, said section comprising two narrow sides in the longitudinal direction of the pin and two wide sides in which identifications are provided which define a central section at which lateral sections are arranged opposite each other with respect to the transverse axis of the cross-section of the pin to give the press fit section a predetermined flexibility, wherein the two lateral sections are symmetrical with respect to both the transverse axis and the longitudinal axis of the cross-section extending normal to the transverse axis, the central section has a substantially square cross-section, the sum of the widths of the two lateral sections is approximately equal to the width of the central section and said lateral sections comprise legs having longitudinal and transverse sides, said legs being elastically flexible relative to the central section and being formed by four slots arranged symmetrical to the longitudinal and transverse axes of said press fit section, and wherein the internal angles formed by each of the four slots are substantially equal to one another, and each said angle is equal to about 30°.

2. Press fit pin according to claim 1 characterized in that the lateral sections are in one piece with the central section.

3. Press fit pin according to claim 1 characterized in that the indentations are notches tapering toward the longitudinal axis.

4. Press fit pin according to claim 1 characterized in that the press fit region has a lead-in section and a second contact end, and in that at the lead-in section there are sides limiting the angles which angles decrease to zero toward the second contact end.

5. Press fit pin according to claim 4 characterized in that one of said sides of the slots defining said angles runs normal to the longitudinal axis in lengthwise direction of the pin.

6. Press fit pin according to claim 1 characterized in that the longitudinal sides of the legs are concave.

7. Press fit pin according to claim 1 characterized in that the transverse sides of the legs are offset toward the longitudinal axis.

8. Press fit pin according to claim 1 characterized in that the bevels are provided between the transverse sides and the longitudinal sides of the legs.

* * * * *